US008469236B2

(12) United States Patent
Kharas

(10) Patent No.: US 8,469,236 B2
(45) Date of Patent: Jun. 25, 2013

(54) CREDIT CARD SIZED LIQUID CONTAINER AND DISPENSER

(76) Inventor: Caroline Kharas, San Antonio, TX (US)

( * ) Notice: Subject to any disclaimer, the term of this patent is extended or adjusted under 35 U.S.C. 154(b) by 0 days.

(21) Appl. No.: 13/108,204

(22) Filed: May 16, 2011

(65) Prior Publication Data

US 2012/0292345 A1 Nov. 22, 2012

(51) Int. Cl.
*B67D 7/84* (2010.01)

(52) U.S. Cl.
USPC ..... 222/173; 222/78

(58) Field of Classification Search
USPC ..... 222/173, 78, 556, 401, 402, 402.1, 222/321.7–321.9, 165, 385, 386, 464.1, 183
See application file for complete search history.

(56) References Cited

U.S. PATENT DOCUMENTS

| | | | | |
|---|---|---|---|---|
| 5,013,173 | A | 5/1991 | Shiraishi | |
| D348,217 | S * | 6/1994 | Le Prince | D9/687 |
| 5,421,485 | A * | 6/1995 | Furuta et al. | 222/95 |
| 5,678,939 | A | 10/1997 | Ross | |
| 6,318,547 | B1 | 11/2001 | Pianezzola | |
| D453,106 | S * | 1/2002 | Peltrault | D9/687 |
| 6,419,393 | B1 * | 7/2002 | Shibata | 383/202 |
| 6,585,112 | B2 | 7/2003 | Levin et al. | |
| 6,715,603 | B1 | 4/2004 | Uribe | |
| 6,866,439 | B2 | 3/2005 | Steinschaden | |
| D511,688 | S * | 11/2005 | Baron | D9/560 |
| 6,983,864 | B1 * | 1/2006 | Cagle | 222/131 |
| 7,100,180 | B2 | 8/2006 | Wood | |
| 7,296,944 | B2 | 11/2007 | Steinschaden | |
| 8,070,015 | B2 * | 12/2011 | Lee | 222/105 |
| 2003/0006160 | A1 | 1/2003 | Gianbattista | |
| 2003/0071076 | A1 * | 4/2003 | Tenzer et al. | 222/385 |
| 2006/0011660 | A1 * | 1/2006 | Sandlin | 222/321.9 |
| 2006/0207911 | A1 | 9/2006 | Bullock | |
| 2008/0023575 | A1 * | 1/2008 | Trumble et al. | 239/327 |
| 2009/0020443 | A1 | 1/2009 | Kesselman | |
| 2010/0032452 | A1 * | 2/2010 | Sibileau et al. | 222/321.1 |

FOREIGN PATENT DOCUMENTS

GB 2475500 * 5/2011

OTHER PUBLICATIONS

Bayas, Lourdes Sanchez; "Credit-Card Sized Cologne"; Trendhunter Magazine, www.trendhunter.com, Apr. 17, 2008.
Zhangjiagang Huayi Imp & Exp Co., Ltd; "Credit card shape plastic sprayer bottle"; www.alibaba.com; Dec. 2, 2010.
Fancy & Trend Enterprise Co Ltd; "14ml Credit Card Perfume Atomizer"; www.alibaba.com; Dec. 14, 2010.
Choong, Woo; "Chong Woo has developed an Elegant Refillable Pocket Size Travel Containers for Perfumes, Creams and Serums"; www.packaging-int.com; May 21, 2009.

* cited by examiner

*Primary Examiner* — Lien Ngo
(74) *Attorney, Agent, or Firm* — Kammer Browning PLLC

(57) ABSTRACT

A compact liquid container/dispenser shaped and sized with the approximate dimensions of a standard sized credit card. The device includes a flat, generally square container portion capable of holding a small amount of a liquid, such as perfume or cologne. A smaller, flat, generally rectangular, lid portion is attached to the container portion along one edge with flexible hinges. A flat, pump spray dispensing component is fixed on the container portion and extends a suction tube into the liquid contained within the container portion. The lid portion may be closed over the dispensing component so as to cover the mechanism and prevent its inadvertent activation. An alternate embodiment includes a flat, generally square, removable container capsule that may be removed from and replace within the container portion of the device.

14 Claims, 4 Drawing Sheets

CREDIT CARD SIZED LIQUID CONTAINER AND DISPENSER

BACKGROUND OF THE INVENTION

1. Field of the Invention

The present invention relates generally to containers and dispensers for liquids. The present invention relates more specifically to a liquid container and dispenser sized and shaped to be carried in a space configured to receive a standard sized credit card or the like.

2. Description of the Related Art

A wide variety of liquid compounds have been created for use by individuals for a variety of purposes. It is beneficial where, for a number of these liquid compounds, it is possible for an individual to carry a small amount of the liquid with them for use as they might move from place to place. Liquids such as fragrances, colognes, breath fresheners, skin cleansers, etc. all benefit from being packaged in such a way that individuals may carry and dispense small quantities of the liquid as needed.

Efforts in the past to provide containers and dispensers for liquids that are carried about by the user have generally focused on simply scaling down the dimensions of a regular sized container/dispenser for the liquid. This usually meant that the user had to accommodate carrying the smaller bottle loosely in a purse or pocket. Such containers/dispensers were subject to both being lost or at best inconvenient to access. In some cases, the dispensers were subject to accidentally being activated while being carried.

Further efforts have been made, especially in the area of perfumes and colognes, to provide single application packets or containers that, once used, were disposed of. Although more convenient these packets failed to solve a number of the problems identified above with smaller bottle type containers. Such single application packets could not be re-used and were sometimes subject to being activated or opened accidentally while being carried. There was no convenient place to put them in a purse, pocket, or wallet. Further efforts at creating a container/dispenser that had a more convenient shape (such as might more easily fit into a purse or pocket, failed to provide convenient dispensing systems, relying instead on swab type applicators that often failed to evenly apply the liquid.

It would therefore be desirable to have a liquid container/dispenser that was both compact and easy to carry within ordinary dress accessories such as purses, wallets, and pockets. It would be beneficial if the compact container/dispenser was configured to be received into a space already structured in purses and wallets for carrying other objects. It would be beneficial if the dispenser function of the container could provide an even dispensing of the liquid as needed and yet not be subject to accidental activation while being carried. It would be further beneficial if the container/dispenser could be configured into a refillable embodiment that would allow the user to switch out the type of liquid being carried.

SUMMARY OF THE INVENTION

In fulfillment of the above objectives the present invention provides a compact liquid container/dispenser shaped and sized with the approximate dimensions of a standard sized credit card. The device includes a flat, generally square container portion capable of holding a small amount of a liquid. A smaller, flat, generally rectangular, lid portion is attached to the container portion along one edge with flexible hinges. A flat, pump spray dispensing component is fixed on the container portion and extends a suction tube into the liquid contained within the container portion. The lid portion may be closed over the dispensing component so as to cover the mechanism and prevent its inadvertent activation. An alternate embodiment includes a flat, generally square, removable container capsule that may be removed from and replace within the container portion of the device. Various liquids may be contained, carried, and dispensed from the device, including perfumes, colognes, breath fresheners, skin cleansers, etc. The device is sized generally the same as a credit card having approximately the same length and width, although having a generally thicker dimension than most credit cards. The device may preferably be constructed of durable but thin plastic molded materials and may include rigid plastic pump mechanism components.

DETAILED DESCRIPTION OF THE PREFERRED EMBODIMENTS

As indicated in the above summary, various additional embodiments of the present invention are anticipated that adhere to the basic elements and components described in association with the preferred embodiments as follows. The fundamental elements of the invention are characterized in the appended claims and generally include: a credit card sized device having a container, removable or integrated, for storing a liquid that may be dispensed using a simple mechanism such as a pump or a capillary flow structure, all of which may be placed in a closed configuration so as to prevent the inadvertent release of the liquid from the container. The following descriptions therefore characterize a number of preferred embodiments implementing these basic concepts and elements.

Figure 1:
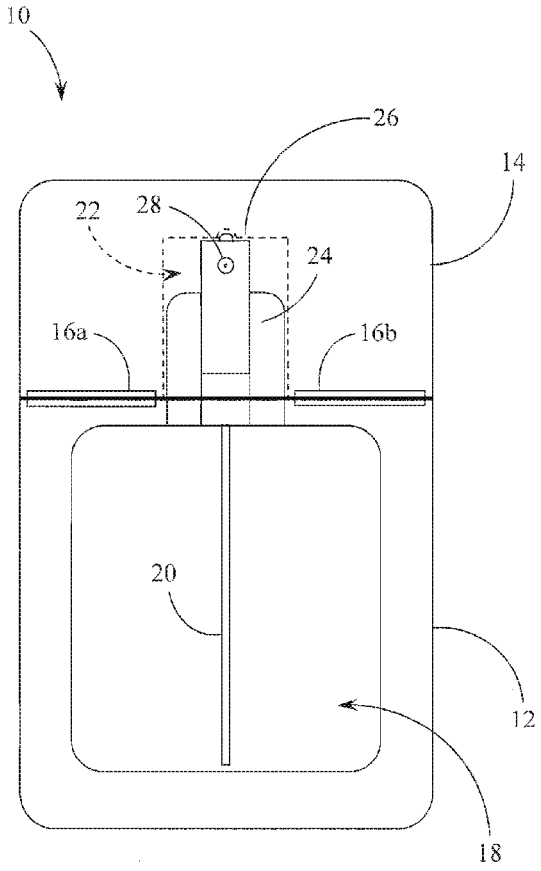
FIG. 1 is a front elevational view of a first preferred embodiment of the container/dispenser of the present invention, shown in a closed configuration.

Reference is made first to FIG. 1 which is a front plan view of a first preferred embodiment of the credit card sized liquid container/dispenser of the present invention. In FIG. 1, container/dispenser 10 is shown in a closed configuration for carrying and/or storage. Container/dispenser 10 is made up primarily of container base 12 and container top/cover 14. Connecting these two components are hinge members 16*a* & 16*b*. In the preferred embodiment, these components may be made from rigid or semi-rigid plastic material that is easily and economically molded into the forms shown. Hinge members 16*a* & 16*b* may simply be heat welded or molded plastic strips that allow container top/cover 14 to be tilted away from container base 12 in the manner described in FIG. 2. It may be preferable for the components of container base 12 to be transparent or semi-transparent so as to allow for confirmation of the presence or absence of the liquid to be dispensed.

Container base 12 defines container interior volume 18 which, though very thin in one dimension, takes up a very large portion of the profile area of the credit card sized device. The present invention anticipates overall dimensions for the device to be consistent with a standard credit card in its profile configuration, namely, 3⅞ inches long by 2⅛ inches wide. The thickness of the device may vary significantly from that of a typical credit card since accessories designed to hold credit cards are generally capable of receiving multiple cards stacked on top of each other or thicker cards, as the case may be. The present invention anticipates a depth dimension on the order of 3/32 inches, which would not be overly large so as to prevent the use of the product in an accessory typically designed to carry credit cards. This would allow for a 1/32 inch thick wall on either side of a 1/32 inch thick container volume forming the device of the present invention.

Positioned within container interior volume 18 is liquid suction tube 20 that extends down from dispenser pump 26 positioned within dispenser body 24. Dispenser spray nozzle 28 is shown oriented to the front for dispensing of the liquid when the container is held in the hand with a finger on top of dispenser pump 26 as is typical.

Figure 2:
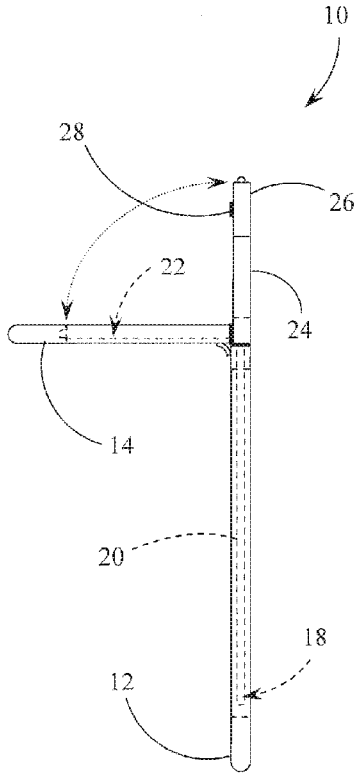
FIG. 2 is a side elevational view of the first preferred embodiment of the container/dispenser of the present invention, shown in an open configuration, ready for dispensing (activation of the pump mechanism).

Reference is next made to FIG. 2 for a side plan view of the first preferred embodiment of the credit card sized perfume/cologne container/dispenser of the present invention. In this view, container/dispenser 10 is shown in an open configuration ready for use and dispensing of the liquid (perfume/cologne, for example). Container/dispenser 10 is again made up primarily of container base 12 and container top/cover 14 which in this view has been rotated 90° on hinge members 16*a* & 16*b*. The thickness dimension of container interior volume 18 containing the liquid to be dispensed is shown in dashed outline form with liquid suction tube 20 likewise shown disposed within interior volume 18 again in dashed outline form. In FIG. 2, container top/cover 14 is shown to be constructed to have a top/cover recess volume 22 defined by a thinner profile for a wall portion of the top/cover 14. This recess volume 22 is sized and positioned to receive dispenser pump 26 and dispenser body 24 when container/dispenser 10 is closed. In the preferred embodiment, container top/cover 14 is designed to be hingedly tilted away from dispenser body 24 and dispenser pump 26 so as to expose dispenser spray nozzle 28 and to otherwise cover it when the container/dispenser 10 is closed. This not only prevents the accidental pumping of dispenser pump 26, but should any leakage occur from dispenser spray nozzle 28, it would occur into recess volume 22 and not into any accessory item holding the credit card sized container.

Figure 3:
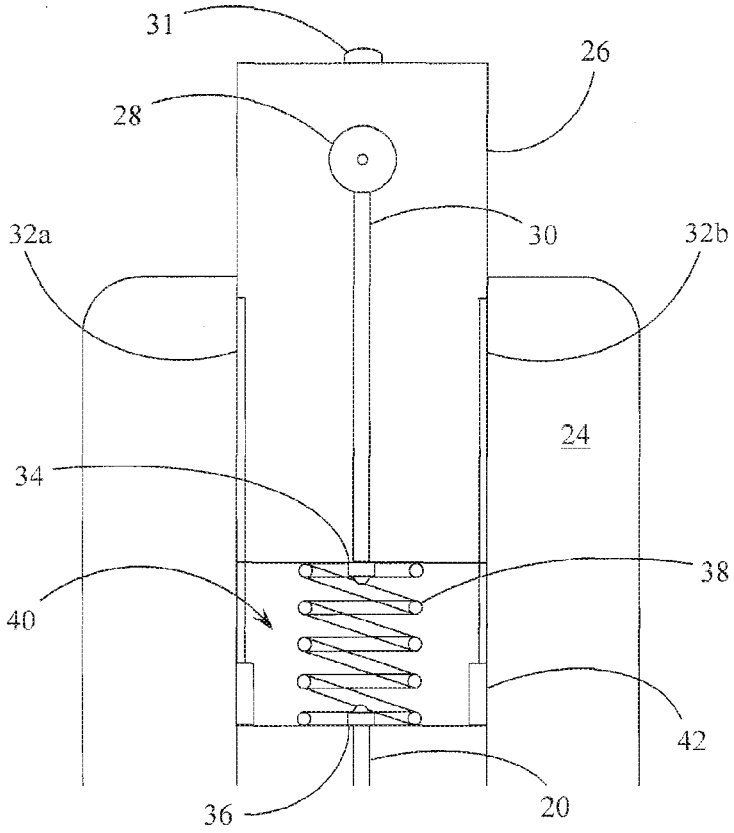
FIG. 3 is a detailed, partial cross-sectional front view, of the pump mechanism of the container/dispenser of the present invention.

Reference is next made to FIG. 3 for a detailed description of a partial cross-sectional view of the pump and dispensing mechanism of the credit card sized perfume/cologne container/dispenser of the present invention. In this detailed view, only the top of liquid suction tube 20 is seen as it is positioned to be disposed within the container interior volume of the device. Liquid suction tube 20 terminates in a one-way reservoir valve 36 that allows for flow of liquid up from the container into the pump mechanism, but not the reverse. This valve 36 opens into pump exchange reservoir 40 which is an interior volume defined by dispenser body 24 and dispenser pump 26. This volume changes according to the manner in which dispenser pump 26 is pressed or forced downward by the user. The downward force of the finger of the user on pump 26 is counteracted by oblong return spring 38. Those skilled in the art will recognize a variety of mechanisms for returning dispenser pump 26 to its original position and for allowing the volume defined by pump exchange reservoir 40 to increase and decrease according to the pumping mechanics utilized.

At an opposite end of pump exchange reservoir 40 is positioned one-way pump valve 34 which terminates pump delivery tube 30 which extends in turn up through the interior of dispenser pump 26. The second (upper) end of pump delivery tube 30 is positioned at dispenser spray nozzle 28. Operation of the pump is as described above, and therefore provides for a one way flow of liquid from the container into pump exchange reservoir 40 and then out through dispenser spray nozzle 28. Dispenser pump 26 is maintained within dispenser body 24 by pump slide rails 32*a* & 32*b* and is prevented from extending too far into pump exchange reservoir 40 by way of stop blocks 42.

The use of oblong return spring 38 not only serves its function in the operation of the pump mechanism, but also assists in retaining container top/cover 14 in its closed condition when the device is not in use. As the spring action provided by oblong return spring 38 directs dispenser pump 26 upward to its fullest extent, this allows for a spring loaded mechanism to retain container top/cover 14. This retention is facilitated by top/cover closure snap 31 which is a protrusion that matches with a recess on the interior top wall of top/cover recess volume 22 positioned in container top/cover 14 (see FIG. 2 for detail).

Figure 4:
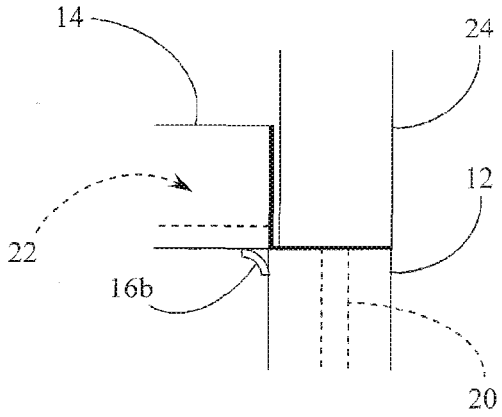
FIG. 4 is a detailed side view of the hinge attachment feature of the container/dispenser of the present invention.

Reference is next made to FIG. 4 for a detailed description of the hinge mechanism of the top/cover hinge structure of the credit card sized perfume/cologne container/dispenser of the present invention. Shown in FIG. 4 is the top part of container base 12 and the bottom part of container top/cover 14. Connecting these two components is hinge member 16*b* (16*a* is hidden in this view). Liquid suction tube 20 is shown in dashed outline form as it extends across the hinge point within dispenser body 24. Dispenser body 24 is therefore seen to extend downward into container base 12 to an extent and in a manner that prevents dispenser body 24 from rotating away with container top/cover 14. Top/cover recess volume 22 is shown to encompass (on three sides) dispenser body 24 when rotated into a closed position.

Figure 5:
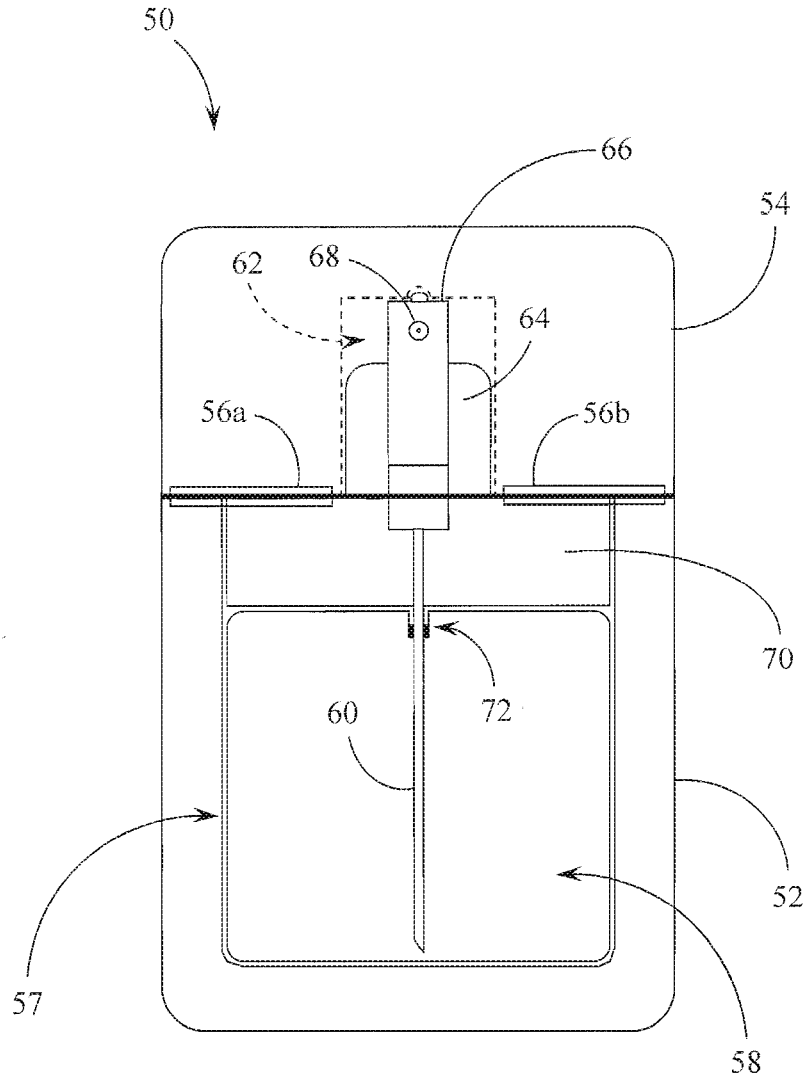
FIG. 5 is a front elevational view of a second preferred embodiment of the container/dispenser of the present invention, having a removable/replaceable liquid container capsule, the device shown in a closed configuration.

Reference is next made to FIG. 5 for a brief description of an alternate embodiment of the present invention that incorporates a removable liquid container capsule. Most of the components shown in FIG. 5 duplicate the corresponding components shown in FIG. 1 with the exception of the structure of the dispenser body and pump, and the added structure of the internal liquid container capsule 58. Container dispenser 50 is shown to be constructed primarily of container base 52 and container top/cover 54. Hinge members 56*a* & 56*b* connect the base and top/cover together. Container interior volume 57 in this case, however, is sized and shaped to receive liquid container capsule 58 in a manner described below. Dispenser body 64 now includes a removable extension 70 sized to fit within the upper portion of container interior volume 57 to an extent that is necessary to position liquid suction tube 60 into the liquid container capsule 58. Pierceable aperture 72 is positioned on a top edge of liquid container capsule 58. Liquid suction tube 60 is configured with a pointed end to facilitate the insertion of suction tube 60 into pierceable aperture 72. As indicated above, the remaining components of the device of this second preferred embodiment of the present invention remain essentially the same as those described above in conjunction with FIG. 1.

Figure 6:
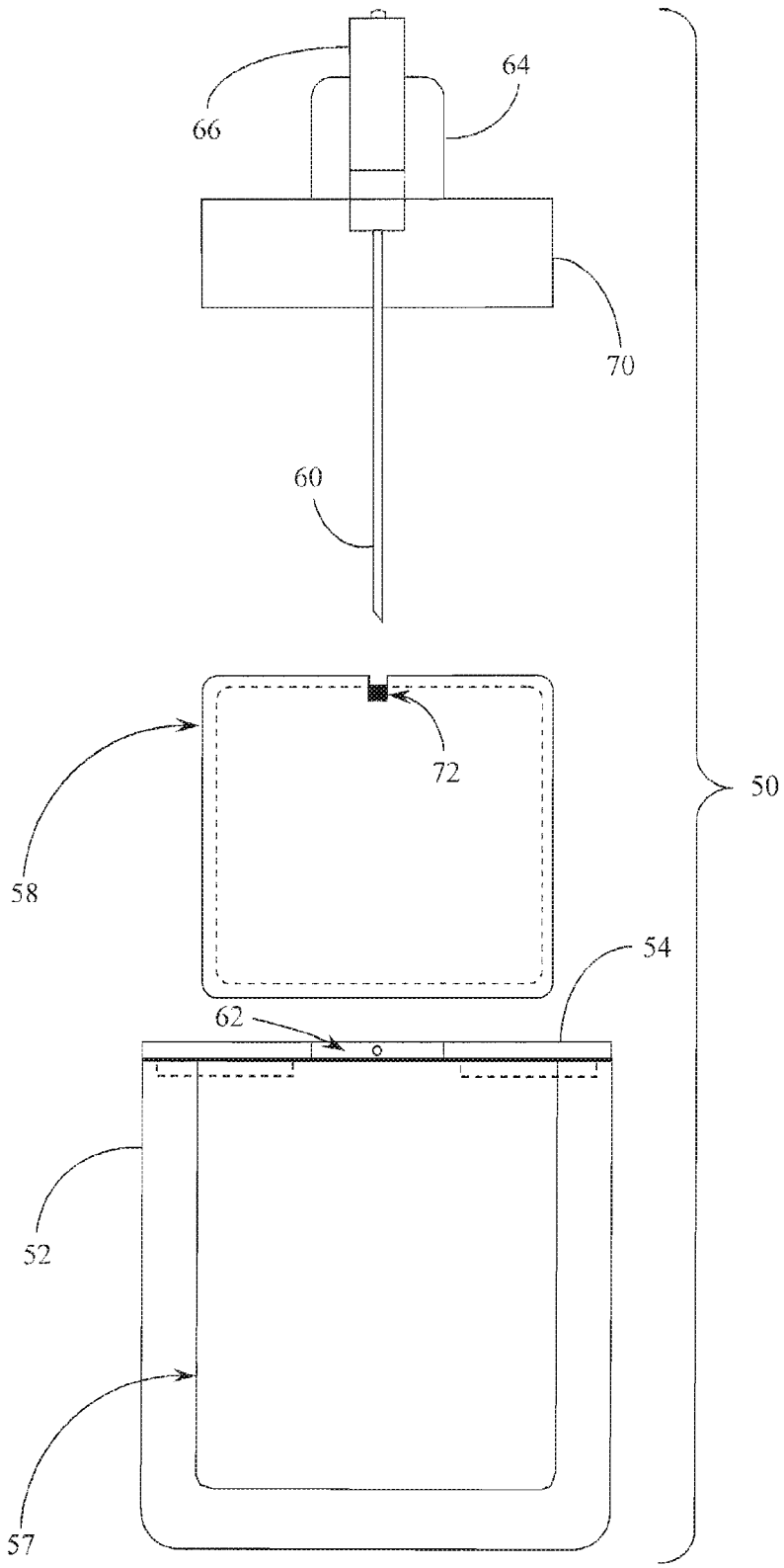
FIG. 6 is an exploded assembly view of the second preferred embodiment of the container/dispenser of the present invention showing the manner of assembly and disassembly of the device.

Reference is next made to FIG. 6 which is an exploded view of the second preferred embodiment shown in FIG. 5 disclosing the various components that may be assembled to construct the container/dispenser of the present invention. In FIG. 6, container/dispenser 50 is shown to be comprised of three primary components. Container base 52 is shown with the remaining components removed. Container top/cover 54 is hidden in this view as it might be when hingedly rotated back (into the page) away from the top of container base 52 as appropriate for the assembly of the device.

Initially inserted into container base 52 is liquid container capsule 58 which is a thin walled flat container that has been pre-filled with the liquid to be dispensed and sealed with the pierceable aperture 72 described above. The user may simply drop the liquid container capsule 58 into container base 52 and thereafter assemble the pump components of the device. Once positioned within container base 52, liquid container capsule 58 orients pierceable aperture 72 as appropriate for reception of liquid suction tube 60 when dispenser assembly 70 is likewise inserted into the upper portion of container interior volume 57 of container base 52. Once assembled in the manner described, container/dispenser 50 operates in much the same manner as the first preferred embodiment of the present invention described above. Use of the second preferred embodiment may be made where different liquids (distinct fragrances for perfumes and colognes, as an example) may be loaded at the time the overall disposable product is given to a customer, such as with a free sample or through other marketing means.

Various other mechanisms for dispensing liquids from the container described are anticipated. In place of the pump mechanism described in the preferred embodiments above, various capillary flow dispensing mechanisms may be utilized. Capillary flow may direct the flow of a liquid through a very thin tube against gravity to an area apart from the liquid reservoir. Such a flow may be facilitated and increased by the squeezing of the container that contains the first end of the capillary tube. In other words, the structure of the present invention, utilizing a suction tube, may be replaced by a capillary dispensing tube terminating in a soft wicking material or the like that allows the user to dispense liquid from the container by capillary flow or by pressure (squeezing) facilitated capillary flow. Each of these embodiments may be implemented in accordance with the basic structures of the present invention sized, as they are to fit into accessories designed to hold credit cards and the like.

I claim:

1. A device for containing and dispensing a quantity of a liquid, the device configured for being carried within a space generally sized to accommodate a standard sized credit card, the device comprising:

(a) a liquid container portion comprising first and second generally rectangular flat walls sealed together on at least three edges thereof, the walls defining an interior volume with an opening on a fourth edge of the walls and the container portion;

(b) a generally flat dispensing mechanism positioned on and extending out from the container portion and extending into the opening thereof, the dispensing mechanism comprising a dispensing tube extending into the interior volume of the container portion; a generally flat fixed lid component supporting the dispensing tube and sealing the opening of the container portion along the fourth edge of the walls thereof; and a generally flat dispensing activation component, the dispensing activation component comprising a pump mechanism, the pump mechanism comprising:

(i) a generally flat walled enclosure defining a pump volume, the walled enclosure having an inlet valve connected to the dispensing tube and an outlet valve;

(ii) a generally flat movable piston component slidingly operable within the walled enclosure to alternately reduce or enlarge the pump volume;

(iii) a dispensing nozzle positioned on the movable piston and in fluid communication with the outlet valve of the walled enclosure; and (iv) a piston return mechanism operable to return the movable piston to a position defining an enlarged pump volume from a position defining a reduced pump volume; and (c) a cover portion hingedly attached to the container portion along the fourth edge of the walls thereof and movable between a closed position at least partially covering the dispensing mechanism extending out from the container portion, and an open position exposing the dispensing mechanism extending out from the container portion, wherein the cover portion comprises a generally flat rectangular solid having a thickness dimension small relative to a width dimension along its hinged edge and a height dimension extending perpendicular to its width, the flat rectangular solid defining a central flat rectangular recess formed into the thickness dimension thereof, the flat recess sized to receive the portion of the generally flat dispensing mechanism extending out from the container portion, thereby covering at least a portion of the movable piston component of the dispensing mechanism and the dispensing nozzle thereof.

2. The device of claim 1 wherein the piston return mechanism is a spring.

3. The device of claim 1 wherein the generally flat walled enclosure comprises first and second generally rectangular flat pump walls sealed together to define the pump volume with the inlet valve and the outlet valve extending from outside to inside the pump volume, the walled enclosure further comprising end stops for confining the movement of the piston component within the walled enclosure.

4. The device of claim 1 wherein the first and second walls of the liquid container portion comprise at least partially transparent material so as to allow the user to view the level of a liquid contained within.

5. The device of claim 1 wherein the generally flat rectangular solid defining the central flat rectangular recess further defines a centrally positioned dimple recess within the thickness dimension of the rectangular solid, and the generally flat movable piston component further comprises a dimple bump on its thickness dimension positioned and sized to align with, and partially retained within, the dimple recess when the cover portion is in the closed position.

6. The device of claim 1 wherein the dimensions of the device are within the range of 3¼ to 3½ inches long; 2 to 2¼ inches wide; and ⅛ to ¼ inch thick.

7. A refillable device for containing and dispensing a quantity of a liquid, the device configured for being carried within a space generally sized to accommodate a standard sized credit card, the device comprising:

(a) a capsule container portion comprising first and second generally rectangular flat walls sealed together on at least three edges thereof, the walls defining an interior volume with an opening on a fourth edge of the walls and the container portion;

(b) a generally flat liquid capsule sized and shaped to be insertable into the interior volume defined by the capsule container portion, the liquid capsule comprising first and second generally rectangular flat capsule walls sealed together on all edges thereof, the liquid capsule further comprising a pierceable port;

(c) a generally flat dispensing mechanism removably positioned on and extending out from the container portion and extending into the opening thereof, the dispensing mechanism comprising a dispensing tube extending through the pierceable port of the liquid capsule when the liquid capsule is inserted into the container portion; a generally flat fixed lid component supporting the dispensing tube and sealing the opening of the container portion; and a generally flat dispensing activation component, the dispensing activation component comprising a pump mechanism, the pump mechanism comprising:

(i) a generally flat walled enclosure defining a pump volume, the walled enclosure having an inlet valve connected to the dispensing tube and an outlet valve;

(ii) a generally flat movable piston component slidingly operable within the walled enclosure to alternately reduce or enlarge the pump volume;

(iii) a dispensing nozzle positioned on the movable piston and in fluid communication with the outlet valve of the walled enclosure; and (iv) a piston return mechanism operable to return the movable piston to a position defining an enlarged pump volume from a position defining a reduced pump volume; and (d) a cover portion hingedly attached to the container portion along the fourth edge of the walls thereof and movable between a closed position at least partially covering the dispensing mechanism extending out from the container portion, and an open position exposing the dispensing mechanism extending out from the container portion, wherein the cover portion comprises a generally flat rectangular solid having a thickness dimension small relative to a width dimension along its hinged edge and a height dimension extending perpendicular to its width, the flat rectangular solid defining a central flat rectangular recess formed into the thickness dimension thereof, the flat recess sized to receive the portion of the generally flat dispensing mechanism extending out from the container portion, thereby covering at least a portion of the movable piston component of the dispensing mechanism and the dispensing nozzle thereof.

8. The device of claim 7 wherein the piston return mechanism is a spring.

9. The device of claim 7 wherein the generally flat walled enclosure comprises first and second generally rectangular flat pump walls sealed together to define the pump volume with the inlet valve and the outlet valve extending from outside to inside the pump volume, the walled enclosure further comprising end stops for confining the movement of the piston component within the walled enclosure.

10. The device of claim 7 wherein the first and second walls of the capsule container portion, and the first and second capsule walls, each comprise at least partially transparent material so as to allow the user to view the level of a liquid contained within.

11. The device of claim 7 wherein the generally flat rectangular solid defining the central flat rectangular recess further defines a centrally positioned dimple recess within the thickness dimension of the rectangular solid, and the generally flat movable piston component further comprises a dimple bump on its thickness dimension positioned and sized to align with, and partially retained within, the dimple recess when the cover portion is in the closed position.

12. The device of claim 7 wherein the dimensions of the device are within the range of 3¼ to 3½ inches long; 2 to 2¼ inches wide; and ⅛ to ¼ inch thick.

13. The device of claim 7 wherein the dispensing tube of the dispensing mechanism comprises a pointed end section and the pierceable port of the liquid capsule comprises a membrane positioned over an aperture through the capsule walls, the pierceable port oriented such that when the liquid capsule is inserted into the container portion and the dispensing mechanism is positioned on the container portion, the pointed end section of the dispensing tube is aligned with the pierceable port.

14. The device of claim 7 further comprising a quantity of fragrance liquid contained within the liquid capsule.

* * * * *